US008284223B2

(12) United States Patent
Mito

(10) Patent No.: US 8,284,223 B2
(45) Date of Patent: Oct. 9, 2012

(54) THERMAL PRINTING MECHANISM, THERMAL PRINTER, AND THERMAL PRINTING METHOD

(75) Inventor: Kenji Mito, Tokyo (JP)

(73) Assignees: Citizen Holdings Co., Ltd., Tokyo (JP); Citizen Systems Japan Co., Ltd., Tokyo (JP)

( * ) Notice: Subject to any disclaimer, the term of this patent is extended or adjusted under 35 U.S.C. 154(b) by 168 days.

(21) Appl. No.: 12/985,696

(22) Filed: Jan. 6, 2011

(65) Prior Publication Data

US 2011/0181678 A1 Jul. 28, 2011

(30) Foreign Application Priority Data

Jan. 26, 2010 (JP) ..... 2010-014402

(51) Int. Cl.
*B41J 2/00* (2006.01)

(52) U.S. Cl. ..... 347/195

(58) Field of Classification Search ..... 347/183, 347/188, 190, 191, 195, 131
See application file for complete search history.

(56) References Cited

U.S. PATENT DOCUMENTS

| | | | | |
|---|---|---|---|---|
| 4,768,042 | A | 8/1988 | Zama | |
| 5,200,761 | A * | 4/1993 | Kawakita et al. | 347/183 |
| 6,175,376 | B1 * | 1/2001 | Austin et al. | 347/188 |
| 2007/0019062 | A1 * | 1/2007 | Koyabu et al. | 347/195 |

FOREIGN PATENT DOCUMENTS

| | | |
|---|---|---|
| JP | S62-260476 | 11/1987 |
| JP | H05-042706 | 2/1993 |
| JP | H05-278253 | 10/1993 |

* cited by examiner

*Primary Examiner* — Kristal Feggins
(74) *Attorney, Agent, or Firm* — Myers Wolin, LLC

(57) ABSTRACT

A thermal printing mechanism includes a head unit having a heating element; an energizing unit that energizes the heating element; and an energizing control unit that controls the energizing unit to energize the heating element for a total energization time set according to a color density of a pixel so that the higher the color density is, the longer the total energization time becomes. The energizing control unit divides the total time period into energization time units, based on printing speed; specifies energization time units for energization so that a sum thereof is equivalent to the total energization time; and performs control so that if the printing speed is lower than a first printing speed, the energization time units appear continuous, and if the printing speed is equal to or higher than the first printing speed, the energization time units do not appear continuous.

20 Claims, 3 Drawing Sheets

THERMAL PRINTING MECHANISM, THERMAL PRINTER, AND THERMAL PRINTING METHOD

CROSS REFERENCE TO RELATED APPLICATIONS

This application is based upon and claims the benefit of priority of the prior Japanese Patent Application No. 2010-014402, filed on Jan. 26, 2010, now pending, the entire contents of which are herein wholly incorporated by reference.

BACKGROUND OF THE INVENTION

1. Field of the Invention

The present invention relates to a thermal printing mechanism, a thermal printer having the thermal printing mechanism, and a thermal printing method.

2. Description of the Related Art

One conventional thermal printer carries out printing (recording) by bringing a heating element whose temperature has been raised into contact with a thermochromic recording medium, causing the portion of thermochromic recording medium coming into contact with the heating element to develop color. Such a thermal printer energizes the heating element to raise the temperature.

Another thermal printer carries out so-called multigradation printing (multigradation recording) in which the period during which energization of the heating element is adjusted to adjust the color density of the recording medium. A thermal printer that carries out such multigradation printing, for example, extends the period that the heating element is energized as the density of a pixel to be printed increases.

Specifically, a conventional technique is known, according to which the total time required for printing one pixel is divided into energization time units represented as powers of 2, based on binary notation, and the heating element is energized for a given energization time unit that has been selected from among the energization time units as a energization time equivalent to the amount of time that the heating element is to be energized. Thus, this technique weights energization times so that the period during which the heating element is energized increases as the density of the pixel to be printed increases.

In this manner, according to the conventional method of carrying out multigradation printing by weighting energization times, energization time units are sorted in descending order or ascending order, and a heating element is energized during a given energization time unit that is selected from among the sorted energization time units based on the density of a pixel to be printed.

Specifically, another conventional technique is known, according to which, for example, the median point of the total time period is matched to the median of the number of heating pulses necessary for achieving printing densities (recording densities) respective to each pixel so that energization equivalent to the number of the necessary heating pulses are carried out consecutively (see, e.g., Japanese Laid-Open Patent Publication No. H5-42706).

Still another conventional technique is known, according to which, for example, when the length of the heating/energization period is changed according to the density of the pixel to be printed, the start of a energization period within the total time period (printing cycle time for one pixel) is controlled so that the interval between the median points of energization periods of consecutive printing cycles becomes substantially equal to the printing cycle time for one pixel (see, e.g., Japanese Laid-Open Patent Publication No. H5-278253).

Yet another conventional technique is known, according to which, for example, when the density gradation of the pixel to be printed is N and the heating time for achieving a coloring area with the maximum density gradation is T, the heating period for achieving coloring areas corresponding to each density gradation is determined to be integral multiple T/(N−1) and such heating periods corresponding to density gradations are arranged as a first half portion and a latter half portion that are substantially equal to each other with respect to the point of elapse of T/2 from the start of the heating period T (see, e.g., Japanese Laid-Open Patent Publication No. S62-260476).

When energization is carried out by weighting energization times, as in the case of binary-based energization, the energization according to the energization times sorted in descending or ascending order may result in the appearance of a white line at a point of gradation change, depending on the printing speed at the time that the energization is carried out. To deal with this problem, the inventor has devised a technique of further dividing each of the already divided energization times into two and carrying out energization in a pattern such that in the total time required for recording one pixel, energization time units for energization appear as a first half portion and a latter half portion that are substantially symmetrical with respect to the median time point of the total time period, to make inconspicuous a white or black line at a point of density change.

If the printing speed is low, however, the printing pattern of the previous line has less influence on the next line. Specifically, a rise in the temperature of a heating element resulting from the energization for the printing of the previous line exerts less influence on the printing of the subsequent line. This leads to a problem in that if the number of divisions of energization times is increased by a further division of each divided energization time into two, etc., in the event of a low printing speed, a disadvantage of a decline in the extent to which the temperature of the heating element rises consequent to the energization, that is, a decline in heat efficiency becomes larger than the effect of making inconspicuous a white or black line at a point of density change.

SUMMARY OF THE INVENTION

It is an object of the present invention to at least solve the above problems in the conventional technologies.

A thermal printing mechanism according to one aspect of the present invention includes a head unit having a heating element; an energizing unit that energizes the heating element; and an energizing control unit that controls the energizing unit to energize the heating element for a total energization time that is set according to a color density of a pixel to be recorded on a recoding medium so that the higher the color density is, the longer the total energization time becomes in a total time period required for recording one pixel. The energizing control unit divides the total time period into a plurality of energization time units of arbitrary lengths, based on printing speed, and from among the divided energization time units, specifies energization time units for energization so that a sum of the energization time units for energization is equivalent to the total energization time. The energizing control unit further controls the energizing unit so that the energization time units for energization appear continuous, if the printing speed is lower than a first printing speed, and controls the energizing unit so that the energization time units for energization do not appear continuous, if the printing speed is equal to or higher than the first printing speed.

DETAILED DESCRIPTION OF THE PREFERRED EMBODIMENTS

Referring to the accompanying drawings, exemplary embodiments of a thermal printing mechanism, a thermal printer, and thermal printing method according to the present invention are explained in detail below.

Figure 1:
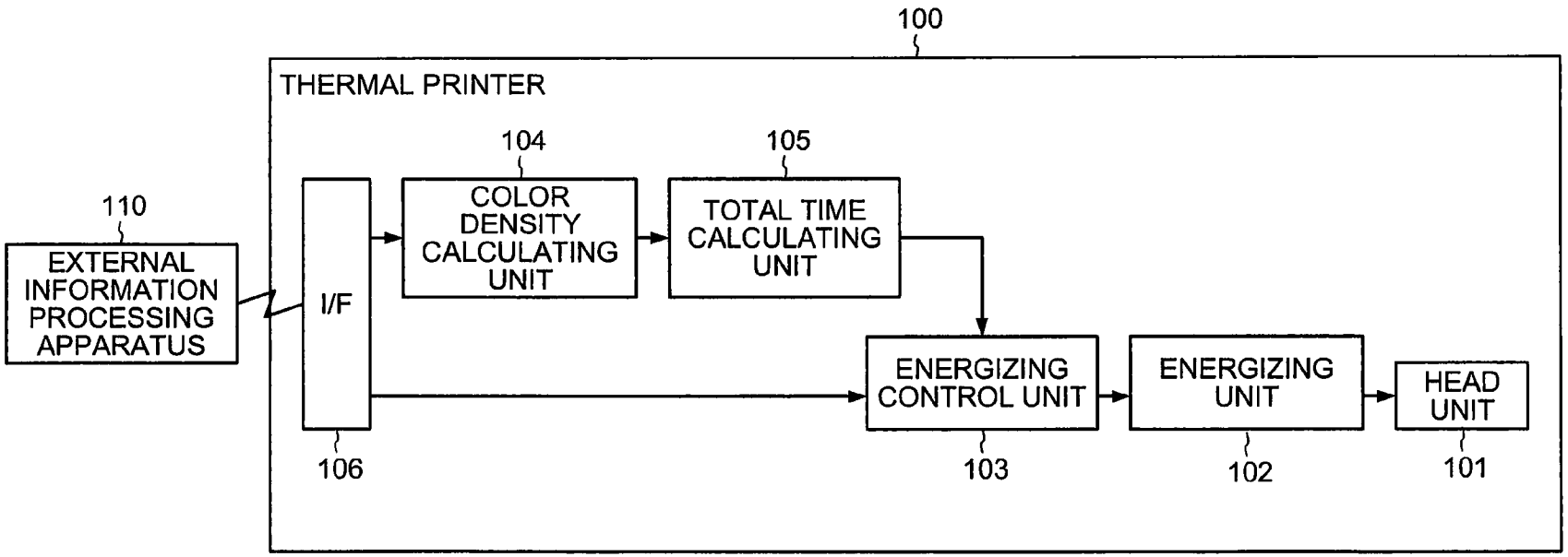
FIG. 1 is an explanatory diagram of a configuration of a thermal printer according to an embodiment of the present invention.

A configuration of a thermal printer according to an embodiment of the present invention will be described. FIG. 1 is an explanatory diagram of a configuration of a thermal printer 100 according to the embodiment. As depicted in FIG. 1, the thermal printer 100 includes a thermal printing mechanism including a head unit 101, an energizing unit 102, an energizing control unit 103, a color density calculating unit 104, and a total time calculating unit 105.

The head unit 101 is disposed opposite to a platen across a recording medium on which recording (printing) is to be performed, and has multiple heating elements (not depicted). Printing includes recording characters and objects other than characters such as symbols, given logos, and images, on the recoding medium.

The thermal printer 100 of the present embodiment uses paper with thermochromic properties, which is so-called thermosensitive paper, as the recoding medium. The thermosensitive paper is made by, for example, coating the paper surface with a leuco dye and a developer. The leuco dye and developer melt when subjected to heat, giving rise to a chemical reaction that causes the leuco dye to develop color, whereby printing is carried out.

The head unit 101 is disposed so that the platen is in contact with the heating elements. The heating elements are elements that generate heat when energized and are disposed in lines parallel to the width of the recording medium (perpendicular to the feed direction of the recording medium). The heating elements are arranged to cover a distance equivalent to the width dimension of the recording medium, thus forming a line head.

The energizing unit 102 is controlled by the energizing control unit 103 to energize the heating elements, each of which is connected to the energizing unit 102. The energizing unit 102 selectively energizes a heating element that is specified based on printing data (as necessary, referred to as "selected heating element"), from among the heating elements.

In printing by the thermal printer 100, the recording medium is guided in between the heating elements of the head unit 101 and the platen, where the energizing unit 102 selectively energizes the heating elements. As a result, the heating element in a temperature-raised state and selected from among the heating elements making up the line head, comes in contact with the recoding medium. Hence, the heating element causes the contacted portion of the recording medium to develop color, whereby printing is carried out. In the printing by the thermal printer 100, printing is carried out at each line of the heating elements making up the line head.

The energizing control unit 103 controls the energizing unit 102 so that within the total time required for printing (recording) one pixel (hereinafter, simply referred to as "total time period"), a selected heating element is energized for an overall period equivalent to the sum of the intervals during which the selected heating element is to be energized (hereinafter "total energization time"). The total energization time is set, for example, according to the color density (set density D) of the pixel to be printed on the recording medium.

In the present embodiment, the color density (set density D) is one factor that is used to calculate the total energization time. Specifically, the color density (set density D) is used to calculate the total energization time for causing the selected heating element to generate heat so that the pixel resulting after the completion of printing by the thermal printer 100 develops a color of the same density as that of a pixel making up an image from which printing data used for printing by the thermal printer 100 originates (hereinafter "original image").

The color density (set density D) in the present embodiment is, therefore, not information that directly indicates the density of a pixel making up the original image. Specifically, for example, if the density of the pixel making up the original image is 4, the density of the pixel printed on the recording medium after the completion of printing by the thermal printer 100 must be 4. The color density (set density D) is used to calculate the total energization time, so that when the temperature of a heating element for printing the corresponding pixel is high, the color density takes a value that makes the total energization time shorter than that when the temperature of the heating element is low.

Meanwhile, when the temperature of the heating element is low because of a low ambient temperature or other cause, the color density (set density D) used to calculate the total energization time takes a value that makes the total energization time longer than that when the ambient temperature is high or when the temperature of the heating element is high consequent to consecutive printing.

The color density (set density D) also varies depending on a difference in the coloring characteristics of the paper to be printed on or a difference in density setting made by a user on the original image. The color density (set density D) serves as a parameter that varies the length of the total energization time during which the selected heating element is to be energized so that the color density of a pixel printed as a result of the energization eventually matches a desired color density (density of the original image or density set by the user). The color density (set density D) is a value preliminarily set at the start of printing each pixel, based on the density of the color to be developed at the completion of printing, for a pixel printed on the recording medium, and does not change during printing.

The color density calculating unit 104 calculates the color density (set density D). The color density calculating unit 104 calculates the color density (set density D), for example, based on information concerning a density assigned to a pixel to be printed and information concerning the energization history of a heating element (history effect Dr).

Information concerning a density assigned to a pixel to be printed is provided as information indicative of the density of each of pixel making up the original image or information indicative of a density set by the user. The density of a pixel, specifically, can be expressed, for example, by using brightness, chroma, etc. In such a case, for example, the higher brightness or chroma of the pixel is, the lower the density of the pixel is.

When the original image is a color image, information including additional information of the hue of a pixel corresponding to the original image may be provided as information concerning the density assigned to a pixel to be printed. Specifically, for example, the density of a pixel representing a dense color such as black and blue can be expressed as a density that is higher than the density of a pixel representing a light color such as yellow and sky blue.

Information concerning the energization history of a heating element (history effect Dr) is a factor that changes for each line, and is provided as information indicative of the energization history of each heating element, spanning from a few given lines prior to the next line to be printed to the line printed immediately before the next line to be printed. Specifically, information concerning the energization history of a heating element (history effect Dr) is provided as information indicative of the frequency at which energization is carried out during a period spanning from a few given lines prior to the next line to be printed to the line printed immediately before the next line to be printed.

Specifically, information concerning the energization history of a heating element (history effect Dr) may be provided, for example, as information indicative of the total amount of time that energization was performed during a period spanning from a few given lines prior to the next line to be printed to the line printed immediately before the next line to be printed. Specifically, information concerning the energization history of a heating element (history effect Dr) may be provided, for example, as information indicative of the present temperature of each heating element. Specifically, information concerning the energization history of a heating element (history effect Dr) may be provided, for example, as information for specifying a printing pattern (energization pattern) that indicates the pattern in which energization has been performed during a period spanning from a few given lines prior to the next line to be printed to the line printed immediately before the next line to be printed.

The total time calculating unit 105 calculates the total energization time based on the color density (set density D) calculated by the color density calculating unit 104. Specifically, the total time calculating unit 105 calculates the total energization time so that the total energization time becomes longer as the color density (set density D) becomes higher and so that the total energization time becomes shorter as the color density (set density D) becomes lower.

The printing of two pixels whose densities in the original image are the same will be described as an example. Here, it is assumed that one pixel is printed by a heating element (for convenience, referred to as "first heating element") to which energization has been continuously performed during a period spanning from the line 5 lines before the next line to be printed to the line printed immediately before the next line to be printed, and one pixel is printed by a heating element (for convenience, referred to as "second heating element") to which energization has not been performed during the period spanning from the line 5 lines before the next line to be printed to the line printed immediately before the next line to be printed.

Under such circumstances, the color density calculating unit 104 calculates color density (set density D) so that the color density of the pixel printed by the first heating element is lower than the color density of the pixel printed by the second heating element. Because the first heating element has been continuously energized during the period spanning from the line 5 lines before the next line to be printed and the line immediately before the next line to be printed, the temperature of the first heating element remains raised to some extent by residual heat. The color density calculating unit 104, therefore, calculates the color density (set density D) of the pixel printed by the first heating element to be a color density lower than the color density (set density D) of the pixel printed by the second heating element. In this manner, the color density (set density D) is calculated by taking into consideration the original density of a pixel to be printed among pixels included in the original image data and the energization history of each heating element.

Based on the color density (set density D) calculated in such a manner, the total time calculating unit 105 calculates a total time period so that the total amount of time during which the first heating element is energized is shorter than the total amount of time during which the second heating element is energized. In this manner, when a pixel of the same density is printed on the next line to be printed, the thermal printer 100 sets a properly adjusted total energization time according to information concerning the energization history of each heating element (history effect Dr). As a result, the original image is well reproduced on the recording medium, as an image with the density of the original image or a density set by the user.

The total time calculating unit 105 may calculate the total energization time based on, for example, such factors as head temperature T, power supply voltage V, printing speed v, and the number of dots n that are energized simultaneously, in addition to information concerning color density (set density D) and the energization history for each pixel. The head temperature T is provided as information for identifying the temperature of each heating element on the head unit 101. Specifically, the head temperature T can be identified, for example, by detecting the temperature of a heating element using a thermistor disposed near the heating element on the head unit 101.

The power supply voltage V is provided as information indicative of the value (magnitude) of a voltage applied to the head unit 101. The maximum value of the power supply voltage V is the voltage supplied from the power supply to the thermal printer 100, and the power supply voltage V varies according to the number of dots n that are simultaneously energized. The number of dots n that are simultaneously energized is a factor that changes for each line, and is provided as information indicative of the number of heating elements that are energized simultaneously among the heating elements of the head unit 101.

For example, when multiple heating elements are energized simultaneously in order to print multiple pixels simultaneously on the same line, that is, when the printing rate is high, a large current flows through the head unit 101. During a period in which such a large current continues to flow through the head unit 101, the voltage drop caused by devices, wiring, etc., between the power supply and the head unit 101 grows to an extent that is not negligible.

This voltage drop caused by devices, wiring, etc., between the power supply and the head unit 101 means an equivalent to a drop in the power supply voltage V, to the head unit 101. Based on this fact, the number of dots n that are simultaneously energized can be included among the factors that determine the power supply voltage V and thus, are taken to be one of factors that specify the power supply voltage V.

In the present embodiment, the total time calculating unit 105 samples changes in the head temperature T and the power supply voltage V for each line, and uses the sampling results to calculate the total energization time. The time it takes the head temperature T or the power supply voltage V to change is significantly long, compared to a time required for printing one line. The head temperature T and the power supply voltage V thus change slowly relative to the changing (transitioning) of lines for printing.

The printing speed v is equivalent to the speed at which the recording medium is conveyed by a motor (not depicted) used for conveying the recording medium. The printing speed v reaches the maximum speed only when the conveyance of the recording medium is carried out without printing operation by the head unit 101. The printing speed v is a factor that changes for each line, and is determined based on energization time, power supply performance, and head performance. The maximum printing speed is determined based on energization time, power supply performance, and head performance, as well as on the performance of the motor used for conveying the recording medium.

The thermal printer 100 of the present embodiment carries out printing at the printing speed v which is one of five-phased printing speeds including a printing speed 1, a printing speed 2, a printing speed 3, a printing speed 4, and a printing speed 5. The printing speeds 1 to 5 represent five successive phases of speed change, where the speed progressively increases in the order of the printing speed 1, the printing speed 2, the printing speed 3, the printing speed 4, and the printing speed 5.

Each of the printing speeds 1 to 5 includes a prescribed speed range (width). Specifically, for example, the printing speed 5 includes a speed range of 300 mm/sec. to 250 mm/sec., and the printing speed 4 includes a speed range of 250 mm/sec. to 200 mm/sec. The printing speed 1 includes the lowest printing speed of 0 mm/sec.

The information concerning the energization history of a heating element (history effect Dr) varies according to past printing patterns and the printing speed v. This means that the information concerning the energization history of a heating element (history effect Dr) varies according to the pattern of energization has been carried out and the printing speed v thereof.

The information concerning the energization history of a heating element (history effect Dr) varies, exerting a small influence when the printing speed v is low and exerting a large influence when the printing speed v is high. Specifically, for example, when the printing speed v is higher than a first printing speed, the printing of a line subsequent to a line on which black has been printed (where printing is carried out with energization performed during the entirety of the total time period) can be carried out with a energization time shorter that is than that for the previous line. The information concerning the energization history of a heating element (history effect Dr) thus varies according to the printing speed v, whereby the total energization time becomes shorter as the printing speed v becomes higher.

The first speed is set based on the influence that the energization history of each heating element of the head unit 101 up to the line immediately before the next line to be printed exerts on the calculation of the total energization time (on the total energization time) when the next printing is carried out by the heating element and based also on the heat efficiency at the head unit 101. In the present embodiment, if the printing speed v has a small effect on the calculation of the total energization time and priority is given to heat efficiency at the head unit 101, the printing speed v is determined to be lower than the first speed. Further, if the printing speed v has a large effect on calculation of the total energization time and priority is given to print quality rather than to heat efficiency at the head unit 101, the printing speed v is determined to be equal to or higher than the first speed. More specifically, in the present embodiment, the boundary between the printing speed 1 and the printing speed 2 is determined to be the first printing speed.

The information concerning the energization history of a heating element (history effect Dr) does not exert an influence in a direction of increasing the printing speed v. In the printing of one line using multiple heating elements, a case is assumed where a certain heating element is used to print white (energization not performed) on the previous line (line immediately before the next line to be printed) and then is energized for the entirety of the total time period. For this reason, the printing speed v is determined based on the maximum energization time in printing on each line.

The printing speed v and the total energization time are factors that affect each other. The printing speed v thus decreases as the total energization time increases, and the total energization time further increases as the printing speed v further decreases. For example, when the head temperature T, the power supply voltage V, and the set density D remain the same but the printing rate is high (number of dots n that are simultaneously energized is large) making division printing necessary, the number of divisions of the total time period increases to 2 or to 3.

When the total time period is divided into 2 or 3 as a result of an increase in the number of divisions of the total time period, the printing speed v decreases to ½ or ⅓ of the original speed. This decrease in the printing speed v results in an increase in the total energization time. Consequently, finding a convergent solution for the printing speed v and the total energization time is preferable in determining the printing speed v and the total energization time. A method of calculating a convergent solution for the printing speed v and the total energization time can be provided using a known technique, and such a method is omitted in further description.

The time the head temperature T or the power supply voltage V takes to change is significantly long, compared to a time required for printing one line. The head temperature T and the power supply voltage V thus change slowly relative to the changing (transitioning) of lines for printing. The thermal printer 100 of the present embodiment samples changes in the head temperature T and the power supply voltage V for each line, and uses the sampling result to calculate the printing speed v.

Before energizing (printing) the selected heating element to carry out printing on the next line, the thermal printer 100 counts the number of dots that are to be simultaneously energized (number of dots n to that are to be simultaneously energized) on the line (the next line to be printed). The thermal printer 100 then calculates an estimate of voltage drop based on the counted number of dots (number of dots n that are to be simultaneously energized), and controls the energizing unit 102 so that the total energization time is increased by an amount equivalent to the calculated estimate of voltage drop (which means a power supply voltage drop to the head).

The printing speed v is set so that printing can be carried out within a range of limitations resulting from the power supply capacity, including "the presence/absence of an energization suspension time due to a limitation on the power supply capacity" and "the presence/absence of energization division printing due to a limitation on peak current at the power supply or the head", in addition to the factors used for calculation of the total energization time (head temperature T, power supply voltage V, printing speed v, number of dots n that are to be simultaneously energized, set density D, history effect Dr, etc.) The limitations resulting from the power supply capacity do not arise when the actual power supply capacity is sufficiently large in comparison with a theoretical power supply capacity that is required in a case of carrying out printing without setting a suspension time or conducting energization division printing with consideration of the thermal head performance and the printing rate.

For example, when the power supply capacity is insufficient relative to the performance of the head unit 101, the number of heating elements on the head unit 101, and the number of dots n that are simultaneously energized, the time during which energization is not performed (suspension time) is set according to the total energization time and the printing rate (number of dots n that are simultaneously energized). When a peak current needs to be suppressed because of the characteristics of the power supply or the head unit 101, division energization is carried out.

In the present embodiment, the functions of the energizing control unit 103, the color density calculating unit 104, and the total time calculating unit 105 are implemented by a microcomputer composed of a CPU and various types of memory such as ROM and RAM. The microcomputer composed of the CPU and various types of memory is easily implemented by the use of a known technique and is, therefore, omitted in further description.

The thermal printer 100 is provided with an I/F (interface) 106 that communicates with an external information processing apparatus 110, which is connected to the thermal printer 100 and transmits image (original image) data to the thermal printer 100, the image data being the original of data used by the thermal printer 100 for printing. The thermal printer 100 receives various types of data transmitted from the external information processing apparatus 110 via the I/F 106.

The external information processing apparatus 110 runs a given application program installed in the external information processing apparatus 110 to write image data (spool data) to be transmitted to the thermal printer 100 onto a given memory via a printer driver, and then transmits to the thermal printer 100, the image data written to the memory. The external information processing apparatus 110 is, specifically, implemented in the form of, for example, a personal computer, which is provided by a known technique and is, therefore, omitted in further description.

For example, when the operation system (OS) of the external information processing apparatus 110 is Windows (registered trademark), spool data is written in formats as such "RAW" and "Enhanced Metafile Format (EMF)". RAW data is written in a language that the thermal printer 100 is able to directly interpret, and is dependent on the type of the thermal printer 100. EMF data is intermediate data written by using a Windows GDI graphic command, and is, therefore, not dependent on the type of the thermal printer 100.

The spool data in the EMF data format is interpreted by the printer driver in background processing, and is transmitted to the thermal printer 100 as final print data suitable for the type of the thermal printer 100. Writing the image data (spool data) to be transmitted to the thermal printer 100 into the EMF data format enables a reduction in the time consumed for interpretation, conversion, etc., of the spool data by the thermal printer 100, compared to a case of the spool data in a format dependent on the type of the thermal printer 100, such as the RAW data format.

Use of the spool data in the EMF data format shortens the time of spooling print data compared to that for the spool data in the RAW data format and thus, results in a reduction in a time consumed for printing. This allows the thermal printer 100 to more effectively exert its advantages of less operation noise, clear and clean printing, and faster printing.

In the thermal printer 100 according to the present embodiment, the energizing control unit 103 divides the total time period into multiple energization time units of arbitrary lengths, and specifies energization time units for energization from among the divided energization time units so that the total of energization time units for energization is equivalent to the total energization time calculated by the total time calculating unit 105.

Specifically, for example, a case of expressing one pixel by 16 gradations (corresponding to color densities 0 to 15) is assumed. When the printing speed v is the printing speed 1, the total time period is divided into 4 energization time units of t, 2t, 4t, and 8t. When the printing speed v is the printing speed 2, the total time period is divided into 5 energization time units of t, t, 2t, 4t, and 7t. When the printing speed v is the printing speed 3, the total time period is divided into 6 energization time units of 2t, t, t, 2t, 3t, and 6t. When the printing speed v is the printing speed 4, the total time period is divided into 7 energization time units of 2t, t, t, t, t, 3t, and 5t. When the printing speed v is the printing speed 5, the total time period is divided into 7 energization time units of 4t, 2t, t, t, t, 2t, and 4t. In this manner, each of the divided energization time units is determined to be a multiple of the minimum energization time unit t, i.e., a unit time (1t) representing the minimum energization time unit.

In the present embodiment, for example, the total time calculating unit 105 carries out calculation of multiplying a color density (set density D) by the minimum energization time unit t to produce the calculated value as a total energization time. Specifically, for example, when one pixel is expressed by 16 gradations (corresponding to color densities 0 to 15), the total time calculating unit 105 calculates the total energization time for a pixel of a color density (set density D) 8, at 8t, and calculates the same for a pixel of a color density (set density D) 7, at 7t. In this manner, the total energization time is determined to be a multiple of the minimum energization time unit t, i.e., a unit time (1t) representing the minimum energization time unit.

The length of the unit time (1t) varies according to the printing speed v in such a way that the unit time (1t) becomes shorter, compared to a case of the low printing speed v, as the printing speed becomes higher. For example, the length of the unit time (1t) at the printing speed 1 may be determined to be 5 times the length of the unit time (1t) at the printing speed 5. Specifically, for example, when the length of the unit time (1t) at the printing speed 5 is 10 μsec in terms of actual time, the length of the unit time (1t) at the printing speed 1 is 50 μsec in terms of actual time.

When printing speed is divided into, for example, 5 levels of printing speeds ranging from the printing speed 1 to the printing speed 5, the length of the unit time (1t) at the printing speed 1 is not necessarily 5 times the length of the unit time (1t) at the printing speed 5. A level number for identifying a printing speed (e.g., "1" of "printing speed 1" and "5" of "printing speed 5") is not always proportional to the length of the unit time (1t) at the level number.

Specifically, for example, each of the printing speeds may be set in such a way that the length of the unit time (1t) at the printing speed 5 is 5 μsec. in terms of actual time while the length of the unit time (1t) at the printing speed 1 is 80 μsec in terms of actual time. In this case, the length of the unit time (1t) at the printing speed 1 is 16 times the length of the unit time (1t) at the printing speed 5. Printing speed is not always divided into 5 levels, but may be divided into 4 or less levels or into 6 or more levels.

In specifying energization time units for energization from among the divided energization time units, when the printing speed v is lower than the first speed, the energizing control unit 103 specifies the energization time units for energization so that the energization time units for energization appear continuous, and controls the energizing unit 102 so that the selected heating element is energized during the specified energization time units for energization. In the present embodiment, for example, when the printing speed v is within the speed range of the printing speed 1, the printing speed v is lower than the first speed.

In specifying energization time units for energization from among the divided energization time units, when the printing speed v is equal to or higher than the first speed, the energizing control unit 103 specifies the energization time units for energization so that the energization time units for energization do not appear continuous for a period equal to or longer than a energization control switching determining time, and controls the energizing unit 102 so that the selected heating element is energized during the specified energization time units for energization. In the present embodiment, for example, when the printing speed v is within the speed ranges of the printing speeds 2 to 5, the printing speed v is equal to or higher than the first speed.

For example, when the printing speed v is the printing speed 2, the total energization time 8t is divided into the energization time unit t appearing first in the total time period and the energization time unit 7t appearing last so that energization is not carried out for a period longer than the energization time unit 7t. In this case, the selected heating element is continuously energized during the energization time unit 7t appearing last in the total time period.

For example, when the printing speed v is the printing speed 3, the total energization time 8t is divided into the energization time unit 2t appearing first in the total time period and the energization time unit 6t appearing last so that energization is not carried out for a period longer than the energization time unit 6t. In this case, the selected heating element is energized continuously during the energization time unit 2t appearing first in the total time period and during the energization time unit 6t appearing last.

For example, when the printing speed v is the printing speed 4, the total energization time 8t is divided into the energization time unit 3t appearing first in the total time period and the energization time unit 5t appearing last so that energization is not continuously carried out for a period longer than the energization time unit 5t. In this case, the selected heating element is energized continuously during the energization time unit 3t appearing first in the total time period and during the energization time unit 5t appearing last.

For example, when the printing speed v is the printing speed 5, the total energization time 8t is divided into the energization time unit 4t appearing first in the total time period and the energization time unit 4t appearing last so that energization is not continuously carried out for a period longer than the energization time unit 4t. In this case, the selected heating element is energized continuously during the energization time unit 4t appearing first in the total time period and during the energization time unit 4t appearing last.

In the present embodiment, when the printing speed v is any one of the printing speeds 1 to 5, the energization control switching determination time can be set to the lower limit of the period of time in which print quality is negative affected consequent to the energization being continuously carried out. Furthermore, each energization control switching determination time is set separately for the printing speed 1, for the printing speed 2, for the printing speed 3, for the printing speed 4, and for the printing speed 5.

In this manner, independent energization control switching determination times are set as an energization control switching determination time 7t for the case of the printing speed v being the printing speed 2, an energization control switching determination time 6t for the case of the printing speed v being the printing speed 3, an energization control switching determination time 5t for the case of the printing speed v being the printing speed 4, and an energization control switching determination time 4t for the case of the printing speed v being the printing speed 5. The energization control switching determination time is thus determined to be shorter as the printing speed v becomes higher. By varying the energization control switching determination time according to the printing speed v, printing is carried out while taking into consideration for each printing speed v, the influence of the history effect Dr as well as heat efficiency improvement.

When the printing speed v is equal to or higher than the second printing speed, in particular, the energizing control unit 103 controls the energizing unit 102 so that energization time units for energization and energization time units for no energization appear, in the first half portion and the latter half portion of the total time period, to be substantially symmetrical with respect to the boundary at the middle point of the total time period. In the present embodiment, for example, when the printing speed v is within the speed range of the printing speed 5, the printing speed v is equal to or higher than the second printing speed.

The second speed is set based on the influence that the energization history of each heating element of the head unit 101, covering up to the line immediately before the next line to be printed, exerts on the calculation of the total energization time (on the total energization time) when the next printing is carried out by the selected heating element and further based on selection of energization time units for energization at the next printing, and based also on the degree of heat efficiency at the head unit 101.

In the present embodiment, when the influence on calculation of the total energization time and heat efficiency are particularly great factors of influence and priority should be given to print quality over heat efficiency at the head unit 101 in determining a method of specifying energization time units for energization (energization pattern), the printing speed v in such a case is equal to or higher than the second speed. More specifically, in the present embodiment, the boundary between the printing speed 4 and the printing speed 5 is equivalent to the second printing speed. In the present embodiment, when the printing speed v is equal to or higher than the second speed, the energizing unit 102 is controlled so that energization time units for energization and for no energization appear, in the first half portion and the latter half portion of the total time period, to be substantially symmetrical with respect to the boundary at the middle point of the total time period.

For example, when the printing speed v is within the speed range of the printing speed 5 and a pixel of a color density (set density) 8 is printed, energization is carried out during the energization time unit 4t appearing first in the total time period and is carried out also during the energization time unit 4t appearing last, while no energization is carried out during the energization time units 2t, t, t, and 2t appearing in the middle of the total time period. As a result, the energization time units for energization and the energization time units for no energization appear, in the first half portion and the latter half portion of the total time period, to be substantially symmetrical with respect to the boundary at the middle point of the total time period.

For example, when the printing speed v is within the speed range of the printing speed 5 and a pixel of a color density (set density) 7 is printed, energization is carried out during the energization time units 2t, t, t, and 2t appearing in the middle of the total time period, while no energization is carried out during the energization time unit 4t appearing first in the total time period or during the energization time unit 4t appearing last. As a result, the energization time units for energization and the energization time units for no energization appear, in the first half portion and the latter half portion of the total time period, to be substantially symmetrical with respect to the boundary at the middle point of the total time period.

Figure 2:
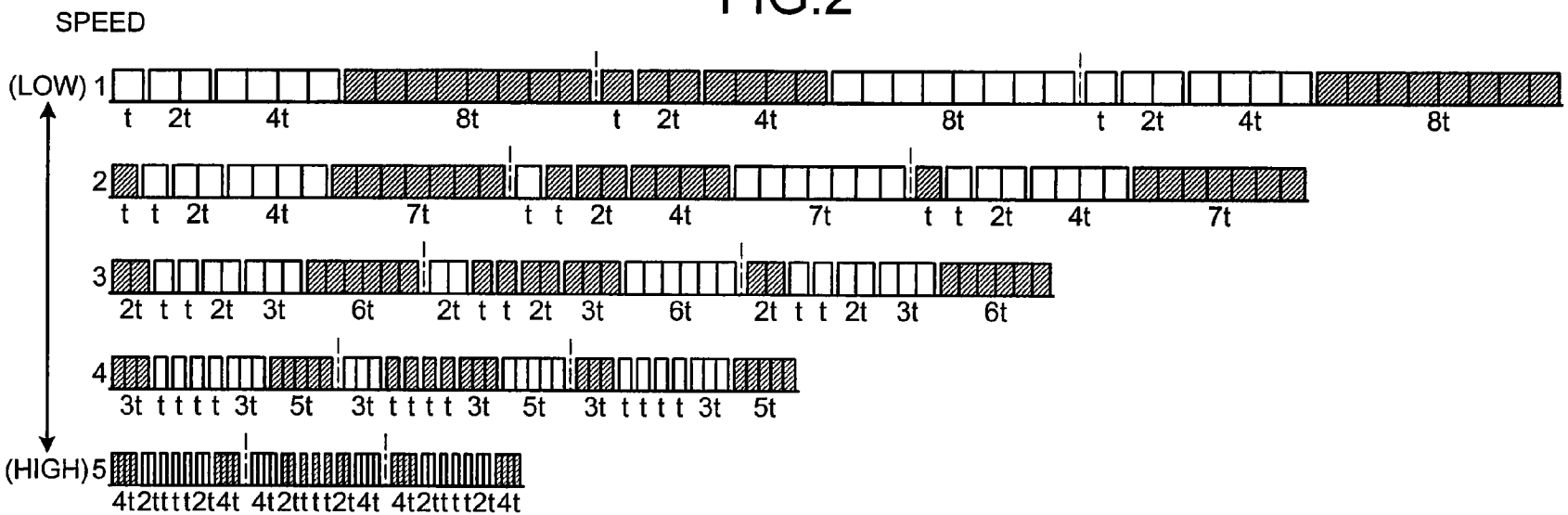
FIG. 2 is an explanatory diagram of a printing method by the thermal printer according to the embodiment.

FIG. 2 is an explanatory diagram of a printing method by the thermal printer 100 according to the embodiment of the present invention. FIG. 2 depicts a case where the thermal printer 100 of the present embodiment is used to print a pixel of a color density (set density D) 8 on the first line, print a pixel of a color density (set density D) 7 on the second line following the first line, and further print a pixel of the color density (set density D) 8 on the third line. FIG. 2 thus depicts an example of the printing method where a pixel of the color density (set density D) 8, a pixel of the color density (set density D) 7, and a pixel of the color density (set density D) 8 are successively printed using a given heating element.

In FIG. 2, the minimum energization time unit t varies in length according to the printing speed v and thus, becomes shorter compared to a case of a low printing speed as the printing speed v becomes higher. An energization control switching determination time, during which energization is continuously carried out, varies in length according to the printing speed v and thus, becomes shorter compared to a case of a low printing speed as the printing speed v becomes higher.

(Printing Speed 1)

When a pixel of the color density (set density D) 8 is printed at the printing speed 1 that is the printing speed v lower than the first speed, the energizing control unit 103 controls the energizing unit 102 so that energization is continuously carried out for a period equivalent to the total energization time 8t. Because the total energization time 8t is equal to the energization control switching determination time 8t in the case of the printing speed v being the printing speed 1, energization is carried out continuously for a period equivalent to the total energization time 8t at the printing speed 1.

When a pixel of the color density (set density D) 7 is printed following printing of the pixel of the color density (set density D) 8, at the printing speed 1 that is the printing speed v lower than the first speed, the energizing control unit 103 controls the energizing unit 102 so that energization is continuously carried out for a period equivalent to a total energization time 7t.

At this time, the energizing control unit 103 controls the energizing unit 102 so that energization for a period equivalent to the total energization time 7t is carried out following energization at printing of the pixel with the color density (set density D) 8 carried out immediately before. Hence, when the pixel of the color density (set density D) 7 is printed, the energizing unit 102 is controlled so that energization is carried out in the first half of the total time period while not being carried out in the latter half of the total time period.

Subsequently, when a pixel of the color density (set density D) 8 is printed following printing of the pixel of the color density (set density D) of 7, at the printing speed 1 that is the printing speed v lower than the first speed, the energizing control unit 103 does not carry out energization in the first half of the total time period and carries out energization for a period equivalent to the total energization time 8t in the latter half of the total time period. As a result, energization time units for no energization appear in series when the pixel of the color density (set density D) 7 and the pixel of the color density (set density D) 8 are printed in increasing order.

(Printing Speed 2)

When a pixel of the color density (set density D) 8 is printed at the printing speed 2, the energizing control unit 103 controls the energizing unit 102 so that energization is continuously carried out for 7t of the total energization time 8t. Because the total energization time 8t is longer than the energization control switching determination time 7t in the case of the printing speed v being the printing speed 2, energization is carried out continuously for the time equivalent to the total energization time 7t, at the printing speed 2.

Further, when a pixel of the color density (set density D) 8 is printed following printing of the pixel of the color density (set density D) 7, at the printing speed v being the printing speed 2, the energizing control unit 103 controls the energizing unit 102 so that energization is continuously carried out, in the total time period, for 7t out of the total energization time 8t.

At this time, the energizing control unit 103 does not carry out energization in the energization time unit t appearing first in the total time period so that energization for the time equivalent to the total energization time 7t carried out at printing of the pixel of the color density (set density D) 7 does not follow the energization carried out immediately before at printing of the pixel of the color density (set density D) 8, and also does not carry out energization during the total energization time 7t appearing last in the total time period.

Subsequently, when a pixel of the color density (set density D) 8 is printed following printing of the pixel with the color density (set density D) 7, at the printing speed v as the printing speed 2, the energizing control unit 103 controls the energizing unit 102 so that energization is continuously carried out for a period equivalent to the total energization time 7t out of the total energization time 8t. Because the total energization time 8t for printing the pixel of the color density (set density D) 8 is longer than the energization control switching determination time 7t in the case of the printing speed v being the printing speed 2, energization is continuously carried out for a period equivalent to the total energization time 7t when the printing speed v is the printing speed 2.

In this manner, energization is continuously carried out for a period equivalent to the total energization time 7t in the longest energization to secure fine heat efficiency while energization is not continuously carried out for a time longer than the total energization time 7t, but rather the energization time units for energization are distributed. As a result, even if pixels arranged in series have respectively different color densities, the boundary between the pixels is made inconspicuous.

(Printing Speed 3)

When a pixel of the color density (set density D) 8 is printed at the printing speed v being the printing speed 3, the energizing control unit 103 controls the energizing unit 102 so that energization is continuously carried out for 6t of the total energization time 8t. Because the total energization time 8t is longer than the energization control switching determination time 6t in the case of the printing speed v being the printing speed 3, energization is carried out continuously for a period equivalent to the total energization time 6t, at the printing speed 3.

Further, when a pixel of the color density (set density D) 8 is printed following printing of the pixel of the color density (set density D) 7, at the printing speed v being the printing speed 3, the energizing control unit 103 controls the energizing unit 102 so that except during the first energization time unit 2t appearing in the total time period and during the energization time unit 6t appearing last, energization is continuously carried out, during energization time units t, t, 2t, and 3t.

The energizing control unit 103 can thus control the energizing unit 102 so that energization is carried out during the energization time units t, t, 2t, and 3t and not continuously as in the case of the printing of the pixel of the color density (set density D) 8 carried out immediately before. Subsequently, when a pixel of the color density (set density D) 8 is printed following printing of the pixel of the color density (set density D) 7, at the printing speed v being the printing speed 3, the energizing control unit 103 controls the energizing unit 102 so that energization is continuously carried out for a period equivalent to the total energization time 6t out of the total energization time 8t.

In this manner, when the pixel of the color density (set density D) 8 is printed at the printing speed v being the printing speed 3, energization is continuously carried out for a period equivalent to the total energization time 6t, which is the longest energization, thereby securing fine heat efficiency while energization is not continuously carried out for a period longer than the total energization time 6t but rather energization time units for energization are distributed in the total time period, whereby even if pixels arranged in series have respectively different color densities, the boundary between the pixels is made inconspicuous.

In the same manner, configuration may be such that when the pixel of the color density (set density D) 7 is printed at the printing speed v being the printing speed 3, continuous energization for a period longer than the longest energization time 6t is not carried out, but rather energization time units for energization are distributed in the total time period. Consequently, by distributing energization time units for energization, even if pixels arranged in series have respectively different color densities, the boundary between the pixels is made inconspicuous.

(Printing Speed 4)

When a pixel of the color density (set density D) 8 is printed at the printing speed v being the printing speed 4, the energizing control unit 103 controls the energizing unit 102 so that energization is continuously carried out for 5t of the total energization time 8t. Because the total energization time 8t is longer than the energization control switching determination time 5t in the case of the printing speed v being the printing speed 4, energization is carried out continuously for a period equivalent to the total energization time 5t, at the printing speed 4.

Further, when a pixel of the color density (set density D) 8 is printed following printing of the pixel of the color density (set density D) 7, at the printing speed v being the printing speed 4, the energizing control unit 103 controls the energizing unit 102 so that except during the first energization time unit 3t appearing in the total time period and during the energization time unit 5t appearing last, energization is continuously carried out, during energization time units t, t, t, t, and 3t.

The energizing control unit 103 can thus control the energizing unit 102 so that energization is carried out during the energization time units t, t, t, t, and 3t and not continuously as in the case of the printing of the pixel of the color density (set density D) 8 carried out immediately before. Subsequently, when a pixel of the color density (set density D) 8 is printed following printing of the pixel of the color density (set density D) 7, at the printing speed v being the printing speed 3, the energizing control unit 103 controls the energizing unit 102 so that energization is continuously carried out for a period equivalent to the total energization time 5t out of the total energization time 8t.

In this manner, when the pixel of the color density (set density D) 8 is printed at the printing speed v being the printing speed 4, energization is continuously carried out for a period equivalent to the total energization time 5t, which is the longest energization, thereby securing fine heat efficiency while energization is not continuously carried out for a period longer than the total energization time 5t but rather energization time units for energization are distributed in the total time period, whereby even if pixels arranged in series have respectively different color densities, the boundary between the pixels is made inconspicuous.

In the same manner, configuration may be such that when the pixel of the color density (set density D) 7 is printed at the printing speed v being the printing speed 4, continuous energization for a period longer than the longest energization time 5t is not carried out, but rather energization time units for energization are distributed. Consequently, by distributing energization time units for energization, even if pixels arranged in series have respectively different color densities, the boundary between the pixels is made inconspicuous.

(Printing Speed 5)

When a pixel of the color density (set density D) 8 is printed with the printing speed v being at a speed equal to or greater than the printing speed 2, e.g., the printing speed 5, the energizing control unit 103 controls the energizing unit 102 so that energization is continuously carried out for 4t of the total energization time 8t. Because the total energization time 8t is longer than the energization control switching determination time 4t in the case of the printing speed v being the printing speed 5, energization is carried out continuously for a period equivalent to the total energization time 4t, at the printing speed 5.

When the printing speed v is the printing speed 5, the energizing control unit 103 controls the energizing unit 102 so that, out of energization patterns specified by energization start positions and energization times from the energization start positions in the total time period, a energization pattern in the first half portion of the total time period and a energization pattern in the latter half portion of the total time period are set symmetrical with respect to the boundary at the time-based middle point (hereinafter "middle point") of the total time period.

Further, when a pixel of the color density (set density D) 8 is printed following printing of the pixel of the color density (set density D) 7, at the printing speed v being the printing speed 5, the energizing control unit 103 controls the energizing unit 102 so that except during the first energization time unit 4t appearing in the total time period and during the energization time unit 4t appearing last, energization is continuously carried out, during energization time units 2t, t, t, t, and 2t.

The energizing control unit 103 can thus control the energizing unit 102 so that energization is carried out during the energization time units 2t, t, t, t, and 2t and not continuously as in the case of the printing of the pixel of the color density (set density D) 8 carried out immediately before. Subsequently, when a pixel of the color density (set density D) 8 is printed following printing of the pixel of the color density (set density D) 7, at the printing speed v being the printing speed 5, the energizing control unit 103 controls the energizing unit 102 so that energization is continuously carried out for a period equivalent to the total energization time 4t out of the total energization time 8t.

When the printing speed v is the printing speed 5, the energizing control unit 103 also controls the energizing unit 102 at printing of the pixel with the color density (set density D) 7 so that, among energization patterns specified by energization start positions and energization times from the energization start positions in the total time period, a energization pattern in the first half portion of the total time period and a energization pattern in the latter half portion of the total time period are set symmetrical with respect to the boundary at the middle point of the total time period.

Thus, when the pixel of the color density (set density D) 8 is printed, energization is continuously carried out for a period equivalent to the total energization time 4t, which is the longest energization, thereby securing fine heat efficiency while energization is not continuously carried out for a period longer than the total energization time 4t but rather energization time units for energization are distributed in the total time period, whereby even if pixels arranged in series have respectively different color densities, the boundary between the pixels is made inconspicuous.

In the same manner, configuration may be such that when the pixel of the color density (set density D) 7 is printed at the printing speed v being the printing speed 5, continuous energization for a period longer than the longest energization time 4t is not carried out, but rather energization time units for energization are distributed. Consequently, by distributing energization time units for energization, even if pixels arranged in series have respectively different color densities, the boundary between the pixels is made inconspicuous.

When the thermal printer 100 carries out printing while varying the printing speed v (with the variable printing speed v) in such a manner that the printing speed v is increased from the printing speed 1 to the printing speed 5, it is preferable that energization control carried out while alteration in the printing speed v is in progress be also altered continuously. In printing at intermediate speeds, the printing speed 2, the printing speed 3, and the printing speed 4, the thermal printer 100 of the present embodiment is able to sequentially carry out energization control while changing the division ratio according to each printing speed v. When carrying out printing with the variable printing speed v, therefore, the thermal printer 100 is capable of securing fine heat efficiency, and of making the boundary between the pixels inconspicuous, even if pixels arranged in series have respectively different color densities.

Figure 3:
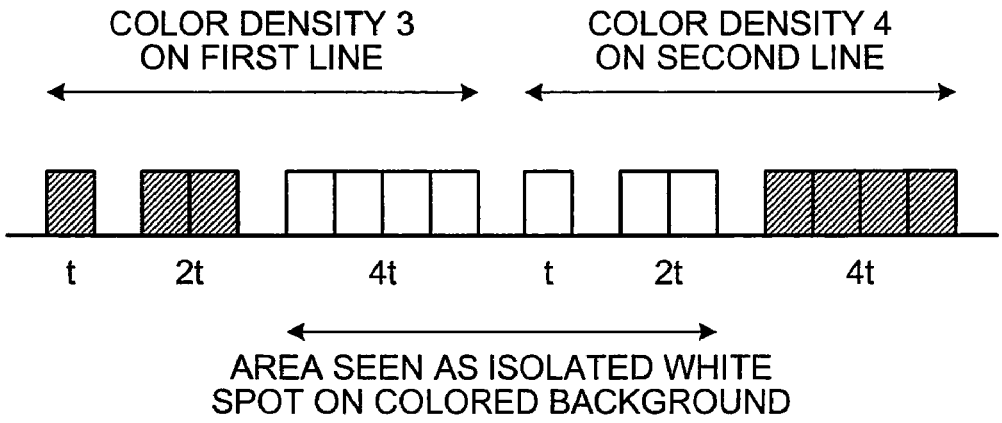
FIG. 3 is a first explanatory diagram of the coloration states of pixels brought about by a conventional multigradation printing method.
Figure 4:
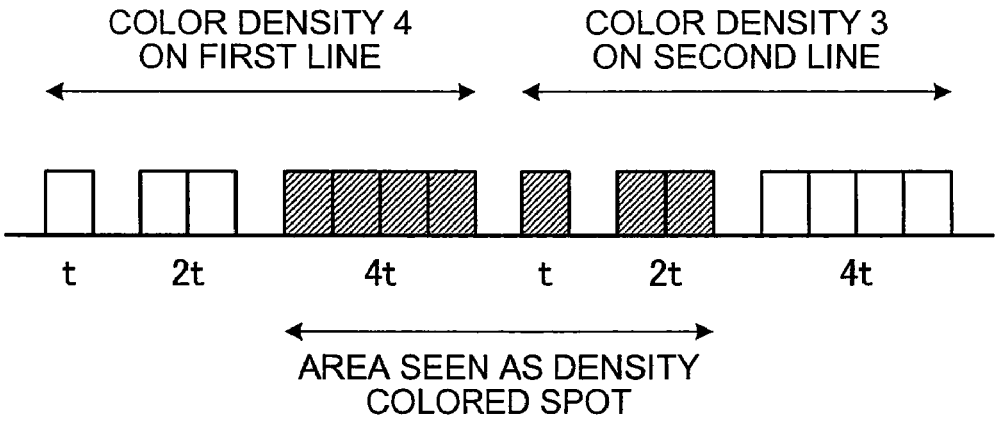
FIG. 4 is a second explanatory diagram of the coloration states of pixels brought about by a conventional multigradation printing method.

FIGS. 3 and 4 are explanatory diagrams of the coloration states of pixels brought about by a conventional multigradation printing method. In FIGS. 3 and 4, when a pixel of a color density 3 and a pixel of a color density 4 are arranged in series, energization time units for no energization or energization time units for energization for these pixels are arranged as successive units. As a result, an area of a white line (which is seen as an isolated area on a colored background) or an area of a dense color (which is seen as an area with an extremely high color density) appears on the boundary between the pixel with the color density 3 and the pixel with the color density 4.

More specifically, for example, because energization time units are arranged in the increasing order of t, 2t, and 4t in each pixel, energization is carried out in the first half of the total time period for the pixel with the color density 3, and then energization is carried out in the latter half of the total time period for the pixel with the color density 4. This results in consecutive energization time units 4t, t, and 2t for no energization (non-colored area equivalent to one pixel). This non-colored area equivalent to one pixel appears conspicuously as an unnatural isolated white area (white line).

More specifically, for example, because energization time units are arranged in the increasing order of t, 2t, and 4t in each pixel, energization is carried out in the latter half of the total time period for the pixel with the color density 4, and then energization is carried out in the first half of the total time period for the pixel with the color density 3. This results in consecutive energization time units 4t, t, and 2t for energization (coloring area equivalent to one pixel). This coloring area equivalent to one pixel appears conspicuously as an area with an unnaturally high color density.

To deal with this problem, when the printing speed v is equal to or higher than the first speed (printing speeds 2 to 5), the thermal printer 100 of the present embodiment takes the history effect D into consideration and controls the energizing unit 102 to distribute energization time units for energization. This prevents an extreme change in gradation for successive pixels.

Hence, even if pixels to be printed successively have respectively different color densities, the boundary between the consecutive pixels is made inconspicuous. In this manner, even if the successive pixels have respectively different color densities, making the boundary between the consecutive pixels inconspicuous improves the reproduction of the original image whose brightness, color, etc., change in a seamless manner.

The extreme gradation change not found in the original image tends to appear more conspicuously as the printing speed v (conveyance speed of the recording medium) is higher. In the present embodiment, when the printing speed v is equal to or higher than the first speed (printing speeds 2 to 5), the printing for which the history effect D is taken into consideration is carried out. This allows printing such that heat efficiency is improved in the case of the printing speed v being low (printing speed 1) while the boundary between adjacent pixels (pixels to be printed successively) is made inconspicuous in the direction of conveyance of the recording medium regardless of the printing speed v. Hence, print quality is improved.

An improvement in the printing speed v of the thermal printer 100 has been demanded in recent years. The thermal printer 100 of the first embodiment offers an excellent effect of making inconspicuous the boundary between consecutive pixels different in their color densities (set density D) as the printing speed v gets higher in response to the variation of the printing speed v.

Each energization time unit obtained by dividing the total time period may be a unit represented in length by a power of 2 or may be a unit represented by a power other than a power of 2. The energization time unit is not limited to a unit represented by a power of 2 and may be, for example, a unit represented by a power of n. The energization time unit may also be a unit obtained by dividing the total time period into units of arbitrary lengths or by dividing the total time period into a given number of units.

When energization time units are determined to be units of arbitrary lengths, a energization time unit equal to or longer than the energization control switching determination time is divided further into two. Based on a total energization time, energization time units for energization are then specified so that the sum of the energization time units for energization from among the overall divided energization time units is equivalent to the total energization time. The energizing control unit 103 controls the energizing unit 102 so that the energization time units for energization and the energization time units for no energization that are specified in the above manner appear, in the first half portion and in the latter half portion of the total time period, to be symmetrical with respect to the boundary at the middle point of the total time period.

In the embodiment above, the functions of the energizing control unit 103, the color density calculating unit 104, and the total time calculating unit 105 are implemented by the microcomputer composed of the CPU and various types of memory as such ROM and RAM. While a case of causing software to implement the functions of the energizing control unit 103, the color density calculating unit 104, and the total time calculating unit 105 has been described so far, this is not the only case. The functions of the energizing control unit 103, the color density calculating unit 104, and the total time calculating unit 105 may also be implemented by a large scale integration (LSI) system.

As described above, the present embodiment includes the head unit 100 having a heating element; the energizing unit 102 that energizes the heating element; and the energizing control unit 103 that controls the energizing unit 102 to energize the heating element for a total energization time that is set according to a color density of a pixel to be recorded on a recoding medium so that the higher the color density is, the longer the total energization time becomes in a total time period required for recording one pixel. The energizing control unit divides the total time period into a plurality of energization time units of arbitrary lengths, based on printing speed, and from among the divided energization time units, specifies energization time units for energization so that a sum of the energization time units for energization is equivalent to the total energization time. The energizing control unit further controls the energizing unit so that the energization time units for energization appear continuous, if the printing speed is lower than a first printing speed, and controls the energizing unit so that the energization time units for energization do not appear continuous, if the printing speed is equal to or higher than the first printing speed.

According to the present embodiment, when the printing speed v is lower than the first speed in printing for one pixel carried out through energization for a time equivalent to multiple energization time units, energization is continuously carried out during the energization time units. In such printing for one pixel, energization is carried out first during a energization time unit for a energization and then the next energization is carried out during a energization time unit for the next energization before the temperature of the head unit 101 drops. This improves heat efficiency at the head unit 101 and allows the pixel to well develop color even if the printing speed is in a range of a low printing speed.

According to the present embodiment, when the printing speed v is equal to or higher than the first speed in printing for one pixel carried out through energization for a time equivalent to multiple energization time units, energization time units for energization are distributed within the total time period required for printing for one pixel. In such printing for one pixel, for example, energization is not carried out further on the head unit 101 that is in a high-temperature state because of energization carried out during a energization time unit for the previous energization and printing is carried out with the history effect Dr being taken into consideration. When the printing speed v is in a range of a high printing speed, therefore, printing is carried out with the history effect Dr being taken into consideration. This prevents an extreme gradation change between adjacent pixels in the direction of conveyance of the recording medium and makes the boundary between adjacent pixels inconspicuous in the direction of conveyance of the recording medium.

In this manner, according to the present embodiment, printing is carried out with priority being given to high heat efficiency at the head unit 101 or carried out with priority being given to high print quality by taking the history effect D into consideration to make the boundary between adjacent pixels inconspicuous in the direction of conveyance of the recording medium, depending on the printing speed v.

In the present embodiment, the energizing control unit controls the energizing unit so that the energization time units for energization do not appear continuous as a period longer than an energization control switching determination time, when the printing speed is equal to or higher than the first printing speed and the sum of the energization time units for energization is longer than an energization control switching determination time.

According to the present embodiment, when the printing speed v is equal to or higher than the first speed in printing for one pixel carried out through energization for a time equivalent to multiple energization time units, energization time units for energization are distributed in the total time period required for printing for one pixel so that energization is not continuously carried out longer than the energization control switching determination time. This enables equalization of the color density of each pixel, and equalization of the color density of each pixel leads to prevention of an extreme gradation change between adjacent pixels in the direction of conveyance of the recording medium and thus makes the boundary between adjacent pixels inconspicuous in the direction of conveyance of the recording medium. Hence, making the boundary between adjacent pixels inconspicuous in the direction of conveyance of the recording medium improves print quality.

In the present embodiment, the energization control switching determination time is set in such a way that the energization control switching determination time becomes shorter as the printing speed v becomes higher. According to the present embodiment, in printing for one pixel carried out through energization for a period equivalent to multiple energization time units, the period of consecutive energization is made shorter as the printing speed v becomes higher and energization time units for energization are distributed in the total time period required for printing for one pixel.

As a result, the color density of each pixel is surely equalized, and sure equalization of the color density of each pixel enables effective prevention of an extreme gradation change between adjacent pixels in the direction of conveyance of the recording medium. This makes the boundary between adjacent pixels inconspicuous in the direction of conveyance of the recording medium, thus improves print quality.

Further, in the present embodiment, the energizing control unit 103 controls the energizing unit 102 so that the energization time units for energization and energization time units for no energization appear, in a first half portion and a latter half portion of the total time period, to be symmetrical with respect to a boundary at a middle point of the total time period, when the printing speed v is equal to or higher than a second speed (e.g., the printing speed 5).

According to the present embodiment, energization time units for energization and energization time units for no energization are distributed in the first half portion and in the latter half portion of the total time period to be substantially symmetrical with respect to the boundary at the middle point, enabling equalization of the color density of each pixel to be carried out in a more assured manner. Such equalization of the color density of each pixel leads to prevention of an extreme gradation change between adjacent pixels in the direction of conveyance of the recording medium and thus, makes the boundary between adjacent pixels inconspicuous in the direction of conveyance of the recording medium. Hence, making the boundary between adjacent pixels inconspicuous in the direction of conveyance of the recording medium improves print quality.

Further, the present embodiment includes the color density calculating unit 104 that calculates the color density based on information concerning a density assigned to the pixel to be recorded and information concerning energization history of the heating element; and the total time calculating unit 105 that calculates the total energization time based on the color density calculated by the color density calculating unit 104, where the energizing control unit controls 103 the energizing unit 102 based on the total energization time calculated by the total time calculating unit 105.

According to the present embodiment, the total energization time calculated based on a density assigned to a pixel to be printed and also on a color density calculated by taking into consideration the history effect Dr on a heating element is distributed in the first half portion and in the latter half portion of the total time period with respect to the boundary at the middle point. This effectively prevents an extreme gradation change between adjacent pixels in the direction of conveyance of the recording medium and thus, more effectively makes the boundary between adjacent pixels inconspicuous in the direction of conveyance of the recording medium. Hence, making the boundary between adjacent pixels inconspicuous in the direction of conveyance of the recording medium improves print quality.

In this manner, the thermal printer 100 of the embodiment of the present invention is capable of carrying out printing with priority being given to high heat efficiency at the head unit 101 or printing with priority being given to high print quality by taking into consideration the energization history of a heating element according to the printing speed v and thus, is capable of performing optimal printing according to the printing speed v.

In the present invention, when one pixel is printed by the energization over multiple energization time units, the period of continuous energization is shortened as printing speed increases and energization time units during which energization is carried out, are distributed within the total time period required for recording one pixel.

According to the present invention, printing is carried out with priority being given to high print quality by making inconspicuous the boundary between adjacent pixels in the direction of conveyance of the recording medium. Hence, the thermal printer capable of carrying out optimal printing according to a printing speed is provided.

The thermal printing method according to the present invention is for a thermal printing mechanism that comprises a head unit having a heating element, a energizing unit that energizes the heating element, and a energizing control unit that controls the energizing unit to energize the heating element for a total energization time that is set according to a color density of a pixel to be recorded on a recoding medium so that the higher the color density is, the longer the total energization time becomes in a total time period required for recording one pixel. Thermal printing method includes dividing the total time period into a plurality of energization time units of arbitrary lengths, based on printing speed, and from among the divided energization time units, specifying energization time units for energization so that a sum of the energization time units for energization is equivalent to the total energization time, the dividing and the specifying being executed by the energizing control unit; and controlling the energizing unit so that the energization time units for energization appear continuous, if the printing speed is lower than a first printing speed, and controlling the energizing unit so that the energization time units for energization do not appear continuous, if the printing speed is equal to or higher than the first printing speed, the controlling being executed by the energizing control unit.

(Effect)

The thermal printing mechanism, the thermal printer, and thermal printing method according to the present invention effect printing that is carried out with priority being given to high heat efficiency at the head unit or is carried out with priority being given to high print quality by taking the energization history of the heating element into consideration, according to printing speed.

INDUSTRIAL APPLICABILITY

As described above, the thermal printing mechanism, the thermal printer, and the thermal printing method of the present invention are used effectively as a thermal printing mechanism that carries out printing on a recording medium by energizing a heating element to raise the temperature thereof, a thermal printer having the thermal printing mechanism, and the thermal printing method of carrying out printing on a recording medium by energizing a heating element to raise the temperature thereof. The thermal printing mechanism, the thermal printer, and the thermal printing method of the present invention are particularly applicable as a thermal printing mechanism, a thermal printer, and a thermal printing method that allow a printing speed to vary.

What is claimed is:

1. A thermal printing mechanism comprising:

a head unit having a heating element;

an energizing unit that energizes the heating element; and an energizing control unit that controls the energizing unit to energize the heating element for a total energization time that is set according to a color density of a pixel to be recorded on a recoding medium so that the higher the color density is, the longer the total energization time becomes in a total time period required for recording one pixel, wherein the energizing control unit divides the total time period into a plurality of energization time units of arbitrary lengths, based on printing speed, and from among the divided energization time units, specifies energization time units for energization so that a sum of the energization time units for energization is equivalent to the total energization time, and the energizing control unit further controls the energizing unit so that the energization time units for energization appear continuous, if the printing speed is lower than a first printing speed, and controls the energizing unit so that the energization time units for energization do not appear continuous, if the printing speed is equal to or higher than the first printing speed.

2. The thermal printing mechanism according to claim 1, wherein the energizing control unit controls the energizing unit so that the energization time units for energization do not appear continuous as a period longer than a energization control switching determination time, if the printing speed is equal to or higher than the first printing speed and the sum of the energization time units for energization is longer than an energization control switching determination time.

3. The thermal printing mechanism according to claim 2, wherein the energization control switching determination time is set, becoming shorter as the printing speed becomes higher.

4. The thermal printing mechanism according to claim 3, wherein the energizing control unit controls the energizing unit so that the energization time units for energization and energization time units for no energization appear, in a first half portion and a latter half portion of the total time period, to be symmetrical with respect to a boundary at a middle point of the total time period, if the printing speed is equal to or higher than a second speed.

5. The thermal printing mechanism according to claim 4, comprising:

a color density calculating unit that calculates the color density based on information concerning a density assigned to the pixel to be recorded and information concerning energization history of the heating element; and a total time calculating unit that calculates the total energization time based on the color density calculated by the color density calculating unit, wherein the energizing control unit controls the energizing unit based on the total energization time calculated by the total time calculating unit.

6. The thermal printing mechanism according to claim 3, comprising:

a color density calculating unit that calculates the color density based on information concerning a density assigned to the pixel to be recorded and information concerning energization history of the heating element; and a total time calculating unit that calculates the total energization time based on the color density calculated by the color density calculating unit, wherein the energizing control unit controls the energizing unit based on the total energization time calculated by the total time calculating unit.

7. A thermal printer comprising:

the thermal printing mechanism according to claim 3;

a platen disposed opposite to a heating element on a head unit incorporated in the thermal printing mechanism; and a conveying mechanism that conveys a recording medium in a given direction, the recording medium being guided in between the head unit and the platen.

8. A thermal printer comprising:

the thermal printing mechanism according to claim 4;

a platen disposed opposite to a heating element on a head unit incorporated in the thermal printing mechanism; and a conveying mechanism that conveys a recording medium in a given direction, the recording medium being guided in between the head unit and the platen.

9. The thermal printing mechanism according to claim 2, wherein the energizing control unit controls the energizing unit so that the energization time units for energization and energization time units for no energization appear, in a first half portion and a latter half portion of the total time period, to be symmetrical with respect to a boundary at a middle point of the total time period, if the printing speed is equal to or higher than a second speed.

10. The thermal printing mechanism according to claim 9, comprising:

a color density calculating unit that calculates the color density based on information concerning a density assigned to the pixel to be recorded and information concerning energization history of the heating element; and a total time calculating unit that calculates the total energization time based on the color density calculated by the color density calculating unit, wherein the energizing control unit controls the energizing unit based on the total energization time calculated by the total time calculating unit.

11. A thermal printer comprising:

the thermal printing mechanism according to claim 9;

a platen disposed opposite to a heating element on a head unit incorporated in the thermal printing mechanism; and a conveying mechanism that conveys a recording medium in a given direction, the recording medium being guided in between the head unit and the platen.

12. The thermal printing mechanism according to claim 2, comprising:

a color density calculating unit that calculates the color density based on information concerning a density assigned to the pixel to be recorded and information concerning energization history of the heating element; and a total time calculating unit that calculates the total energization time based on the color density calculated by the color density calculating unit, wherein the energizing control unit controls the energizing unit based on the total energization time calculated by the total time calculating unit.

13. A thermal printer comprising:

the thermal printing mechanism according to claim 2;

a platen disposed opposite to a heating element on a head unit incorporated in the thermal printing mechanism; and a conveying mechanism that conveys a recording medium in a given direction, the recording medium being guided in between the head unit and the platen.

14. The thermal printing mechanism according to claim 1, wherein the energizing control unit controls the energizing unit so that the energization time units for energization and energization time units for no energization appear, in a first half portion and a latter half portion of the total time period, to be symmetrical with respect to a boundary at a middle point of the total time period, if the printing speed is equal to or higher than a second speed.

15. The thermal printing mechanism according to claim 14, comprising:

a color density calculating unit that calculates the color density based on information concerning a density assigned to the pixel to be recorded and information concerning energization history of the heating element; and a total time calculating unit that calculates the total energization time based on the color density calculated by the color density calculating unit, wherein the energizing control unit controls the energizing unit based on the total energization time calculated by the total time calculating unit.

16. A thermal printer comprising:

the thermal printing mechanism according to claim 14;

a platen disposed opposite to a heating element on a head unit incorporated in the thermal printing mechanism; and a conveying mechanism that conveys a recording medium in a given direction, the recording medium being guided in between the head unit and the platen.

17. The thermal printing mechanism according to claim 1, comprising:

a color density calculating unit that calculates the color density based on information concerning a density assigned to the pixel to be recorded and information concerning energization history of the heating element; and a total time calculating unit that calculates the total energization time based on the color density calculated by the color density calculating unit, wherein the energizing control unit controls the energizing unit based on the total energization time calculated by the total time calculating unit.

18. A thermal printer comprising:

the thermal printing mechanism according to claim 17;

a platen disposed opposite to a heating element on a head unit incorporated in the thermal printing mechanism; and a conveying mechanism that conveys a recording medium in a given direction, the recording medium being guided in between the head unit and the platen.

19. A thermal printer comprising:

the thermal printing mechanism according to claim 1;

a platen disposed opposite to a heating element on a head unit incorporated in the thermal printing mechanism; and a conveying mechanism that conveys a recording medium in a given direction, the recording medium being guided in between the head unit and the platen.

20. A thermal printing method of a thermal printing mechanism that comprises a head unit having a heating element, a energizing unit that energizes the heating element, and a energizing control unit that controls the energizing unit to energize the heating element for a total energization time that is set according to a color density of a pixel to be recorded on a recoding medium so that the higher the color density is, the longer the total energization time becomes in a total time period required for recording one pixel, thermal printing method comprising:

dividing the total time period into a plurality of energization time units of arbitrary lengths, based on printing speed, and from among the divided energization time units, specifying energization time units for energization so that a sum of the energization time units for energization is equivalent to the total energization time, the dividing and the specifying being executed by the energizing control unit; and controlling the energizing unit so that the energization time units for energization appear continuous, if the printing speed is lower than a first printing speed, and controlling the energizing unit so that the energization time units for energization do not appear continuous, if the printing speed is equal to or higher than the first printing speed, the controlling being executed by the energizing control unit.

* * * * *